US005908644A

United States Patent [19]

Poole

[11] Patent Number: 5,908,644

[45] Date of Patent: Jun. 1, 1999

[54] CAULK SMOOTHING APPARATUS

[76] Inventor: Daniel L. Poole, 3319 W. Malapai Dr., Phoenix, Ariz. 85051

[21] Appl. No.: 09/002,728

[22] Filed: Jan. 5, 1998

[51] Int. Cl.[6] ..... E04F 21/30; E04F 21/32

[52] U.S. Cl. ..... 425/458; 15/235.3; 15/235.7; 425/87

[58] Field of Search ..... 425/87, 458; 15/235.3, 15/235.7

[56] References Cited

U.S. PATENT DOCUMENTS

| | | | |
|---|---|---|---|
| 2,138,696 | 11/1938 | Francis | 425/87 |
| 2,420,062 | 5/1947 | Ames | 425/87 |
| 4,211,501 | 7/1980 | Pedroso et al. | 425/458 |
| 4,380,425 | 4/1983 | Edelman | 425/458 |
| 4,570,834 | 2/1986 | Ward | 425/87 |
| 4,695,185 | 9/1987 | Spells et al. | 425/87 |
| 5,017,113 | 5/1991 | Heaton et al. | 425/87 |
| 5,413,258 | 5/1995 | Kartler | 425/87 |
| 5,622,728 | 4/1997 | Kartler | 425/87 |
| 5,695,788 | 12/1997 | Woods | 425/87 |

*Primary Examiner*—Patrick Ryan
*Assistant Examiner*—Joseph Leyson
*Attorney, Agent, or Firm*—Parsons & Goltry; Robert A. Parsons; Michael W. Goltry

[57] ABSTRACT

Smoothing apparatus for smoothing flowable materials including a support portion having an end and a smoothing portion coupled to the support portion proximate said end for use in smoothing the flowable material.

5 Claims, 3 Drawing Sheets

CAULK SMOOTHING APPARATUS

FIELD OF THE INVENTION

This invention relates to devices for facilitating the use of caulking materials.

BACKGROUND OF THE INVENTION

Caulk materials are often used to fill cracks and joints between surfaces. Since the bead of caulk material is virtually the last item to be placed, it needs to be uniform and visually pleasing. Thus it is desirable that the bead of caulk be even and smooth. Achieving an even and smooth bead is extremely difficult and generally requires diligent practice to perfect. For the homeowner who seldom caulks, laying and smoothing a bead of caulk can be frustrating and typically results in an unsatisfying bead.

It would be highly advantageous, therefore, to remedy the foregoing and other deficiencies inherent in the prior art.

Accordingly, it is an object of the present invention to provide a new and improved caulk smoothing apparatus.

Another object of the invention is to provide a caulk smoothing apparatus which is easy to use and produces a uniformly smooth bead.

SUMMARY OF THE INVENTION

Briefly, to achieve the desired objects of the instant invention in accordance with a preferred embodiment thereof, provided is smoothing apparatus for smoothing flowable materials. The apparatus includes a support portion having an end and a smoothing portion coupled to the support portion proximate said end for smoothing the flowable material. In a specific embodiment, the support portion includes sidewalls forming a cap receivable by a nozzle of a flowable materials container, and retention means for retaining the smoothing portion. The smoothing portion includes a resilient material in the shape of a cylinder.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
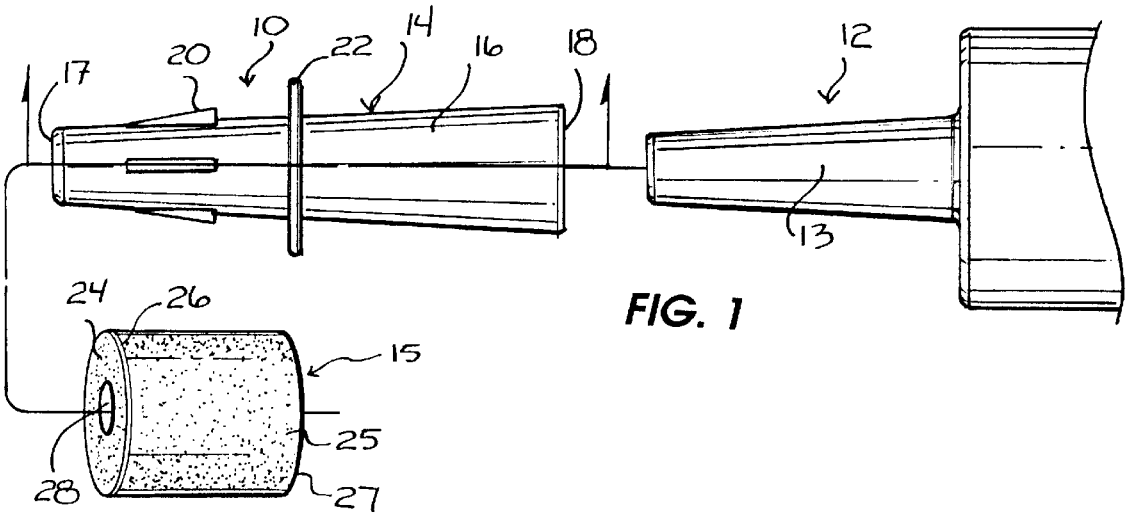
FIG. 1 is a side plan view of a caulk smoothing apparatus according to the present invention, with the smoothing member and the support member separated.

Turning now to the drawings in which like reference characters indicate corresponding elements throughout the several views, attention is first directed to FIG. 1 which illustrates a caulk smoothing apparatus generally designated by the reference numeral 10 and the end of a caulking tube 12 with tapered dispensing nozzle 13. It should be noted that although the present invention is shown and described with reference to a caulking tube, apparatus 10 is also intended to be used with other containers and flowable materials such as squeeze tubes and sealants, respectively, etc.

Caulk smoothing apparatus 10 includes a support portion 14, which in this embodiment acts as a cap for caulk tube 12, and a smoothing member 15. Support portion 14 has a generally tubular sidewall 16 extending between a closed end 17 and an open end 18. Support portion 14 receives dispensing nozzle 13 through open end 18. Dispensing nozzle 13 extends through open end 18 substantially to closed end 17, and in this specific embodiment, does not materially add to the length of dispensing nozzle 13. This allows the use of existing packaging.

Figure 2:
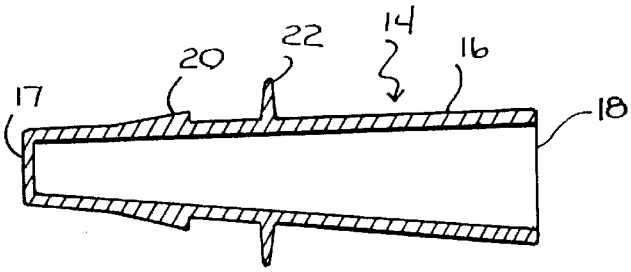
FIG. 2 is a sectional side view of a support portion of the caulk smoothing apparatus of FIG. 1.

With additional reference to FIG. 2, support portion 14 is tapered outward from closed end 17 to open end 18. Preferably, a taper of three degrees is utilized to match the taper of conventional dispensing nozzles. It will be understood that this angle may vary. Sloped ribs 20 extend from sidewall 16 proximate closed end 17, with the slope extending outward, away from sidewall 16, in the direction of open end 18. Ribs 20 are preferably evenly spaced about sidewall 16, and are preferably at least two in number, although one may be sufficient. A flange 22 extends from and encircles sidewall 16 intermediate open end 18 and ribs 20.

Figure 3:
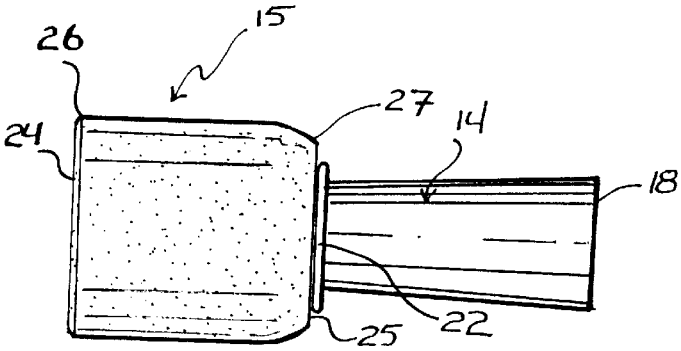
FIG. 3 a side plan view of the caulk smoothing apparatus of FIGS. 1 and 2.

Still referring to FIG. 1, smoothing member 15 is preferably formed of cylindrical sponge material having opposing ends 24 and 25, each having outer edges 26 and 27. It will be understood that a variety of materials may be employed, typically being of resilient material. A bore 28 extends from end 24 to end 25, and receives support portion 14 therein. With additional reference to FIG. 3, smoothing member 15 is carried by support portion 14 proximate closed end 17. Smoothing member 15 is positioned by forcing closed end 17 into bore 28 at end 24 until member 15 is stopped by flange 22. As member 15 is received over support portion 14, ribs 20 slide into bore 28. Ribs 20 act as retaining members, preventing member 15 from being removed from support portion 14 without effort. After extended use, smoothing member 15 may become worn out. It can be replaced, however, ribs 20 will generally cause damage thereto upon removal.

The act of forcing member 15 onto support portion 14 causes the outer surface of member 15 to bow, forming a barrel shape and causing outer edges 26 and 27 to draw inward. This facilitates the use of smoothing apparatus 10, as the edge will be less likely to engage and collect the flowable material. Typically, inner edge 26 will draw inward more than outer edge 27 because of the taper of support portion 14. The degree of bowing can be controlled by the relative diameters of bore 28 and support portion 14. As the diameter of support portion 14 increases relative the diameter of bore 28 more bowing will occur.

Figure 4:
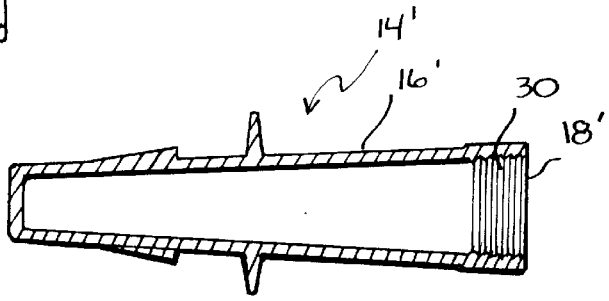
FIG. 4 is a sectional side view of another embodiment of a support portion of a caulk smoothing apparatus.

Turning now to FIG. 4, another embodiment of a support portion, generally designated 14' is illustrated. A prime symbol is employed to designate elements identical to those elements found in embodiment 14. This embodiment is identical to support portion 14 with the exception of threads 30 formed on the inner surface of sidewall 16' proximate open end 18'. Threading permits support portion to be securely and sealingly engaged to containers with threads.

Figure 5:
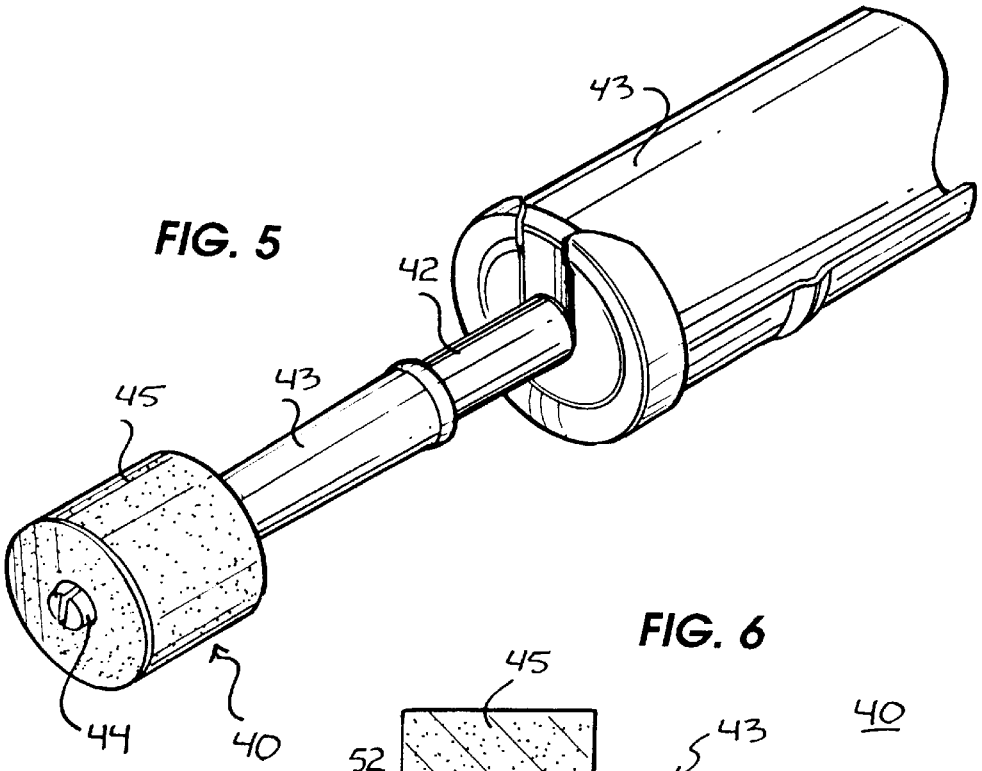
FIG. 5 is a perspective view of another embodiment of a smoothing apparatus according to the present invention.

Referring now to FIG. 5, yet another embodiment of a smoothing apparatus generally designated 40 is illustrated. Smoothing apparatus 40 is shown in engagement with a dispensing nozzle 42 of a caulking tube 43. Apparatus 40 includes a tapered cap portion 43 and a support portion 44 extending therefrom. Support portion 44 rotatably carries a smoothing member 45. Smoothing element 45 is preferably a cylindrical sponge or other resilient material having a bore 46. Bore 46 is lined with a substantially rigid material, such as plastic, in the form of a tubular insert 47 so that smoothing member 45 will easily rotate on support portion 44.

Figure 6:
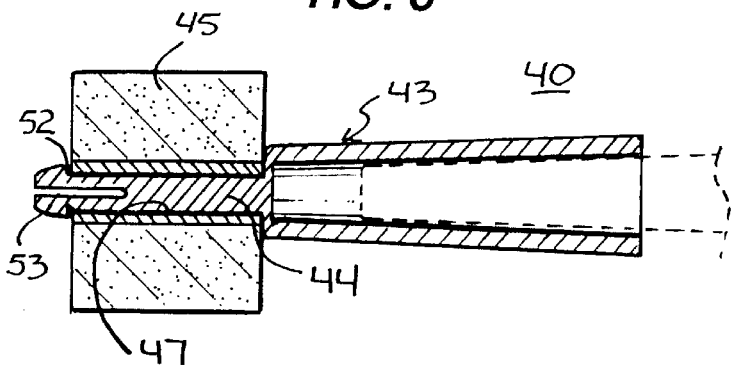
FIG. 6 is a sectional side view of the smoothing apparatus of FIG. 5.
Figure 7:
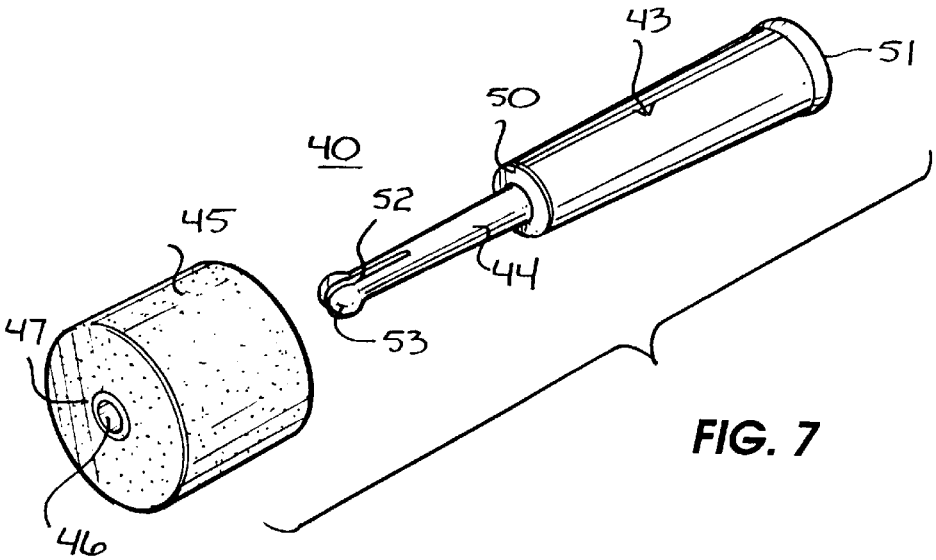
FIG. 7 is an exploded perspective view of the smoothing apparatus of FIGS. 5 and 6.

Referring now to FIGS. 6 and 7, cap portion 43 has a closed end 50 from which support portion 44 extends and an open end 51 for receiving dispensing nozzle 42. Support portion 44 is generally tubular, extends from cap portion 43 and terminates in a bifurcated end 52 with outwardly directed flanges 53. Each furcation is biased outwardly, but can be displaced inwardly to receive smoothing member 45. The outward bias of the furcations and flanges 53 prevent the removal of smoothing member 45 without specifically displacing the furcations inward.

Figure 8:
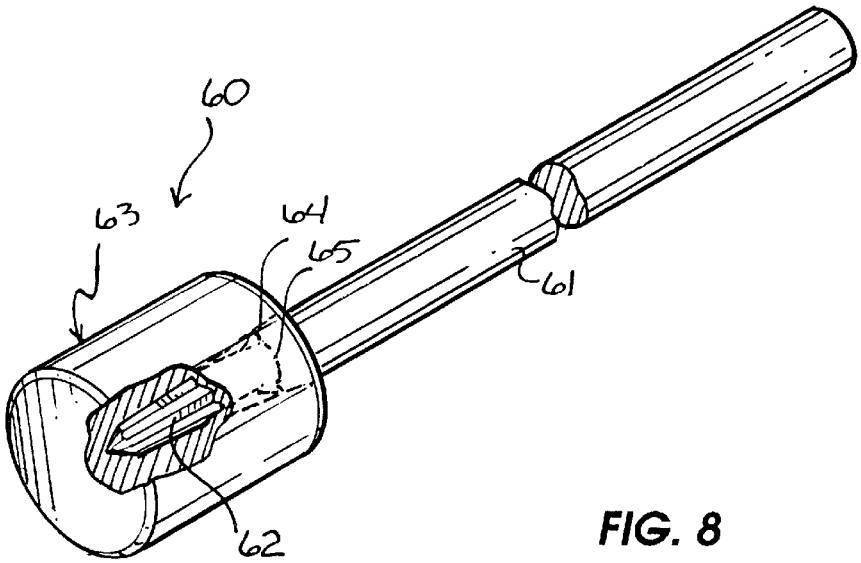
FIG. 8 is a perspective view of yet another embodiment of a caulk smoothing apparatus according to the present invention.
Figure 9:
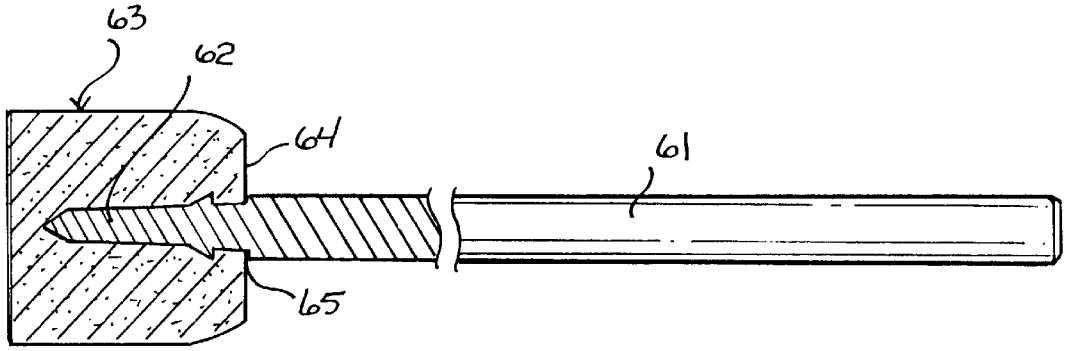
FIG. 9 is a sectional side view of the caulk smoothing apparatus of FIG. 8.

Turning to FIGS. 8 and 9, a further embodiment of a caulk smoothing apparatus generally designated 60, is illustrated. Apparatus 60 differs from the previous embodiments in that it is a hand held device which does not function as a cap for a dispensing tube. Apparatus 60 includes a shaft 61 having an engagement end 62. End 62 is pointed, in this embodiment to be more easily inserted into the resilient material of a smoothing member 63. Again, as in the other embodiments, smoothing member 63 is preferably a resilient cylinder made of sponge or other foam material. In this instance, smoothing member 63 does not have a bore extending therethrough, rather, end 62 of shaft 61 is forced into the material. It will be understood that a bore may be provided as discussed in the previous embodiment, and furthermore, that the previous embodiments can be employed without a bore as described here.

Still referring to FIGS. 8 and 9, sloped ribs 64 extend from shaft 61 proximate end 62, with the slope extending outward, away from shaft 61, in a direction opposite to end 62. Ribs 64 are preferably evenly spaced about shaft 62, and are preferably at least two in number, although one may be sufficient. A shoulder 65 formed in shaft 61 extends therefrom.

Smoothing member 63 is positioned by forcing end 62 into an end thereof until member 63 is stopped by shoulder 65. As member 63 is received over shaft 61, ribs 64 prevent removal. The act of forcing member 63 onto shaft 61 causes the outer surface of member 63 to bow, forming a barrel shape as discussed previously.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. Smoothing apparatus for smoothing flowable material materials in combination with a flowable materials container including a nozzle, the apparatus comprising:

a smoothing portion including a cylindrically shaped resilient material for smoothing the flowable material;

a support portion including sidewalls forming a cap and including a closed end and an open end, the nozzle of the flowable materials container being received through the open end of the support portion; and retention means for retaining the smoothing portion on the support portion adjacent the closed end.

2. The combination as claimed in claim 1 wherein the retention means includes at least one sloping rib extending from the support portion proximate the closed end and sloping outwardly towards the open end.

3. The combination as claimed in claim 2 wherein the retention means further includes a stop extending from the support portion intermediate the open end and the at least one sloping rib, for preventing the smoothing portion from being moved further towards the open end.

4. The combination as claimed in claim 2 wherein the smoothing portion further includes the cylindrically shaped resilient material includes a bore extending therethrough from a first end having a first outer edge to a second end having a second outer edge, the support portion being inserted into the bore.

5. The combination as claimed in claim 4 wherein the cylindrically shaped resilient material is formed into a barrel shape by an inward drawing of the first and second outer edges.

* * * * *